United States Patent [19]

Bergvall

[11] 4,227,472

[45] Oct. 14, 1980

[54] SEWING MACHINE WITH ELECTRONIC PATTERN DATA CIRCUITS

[75] Inventor: Bengt A. Bergvall, Huskvarna, Sweden

[73] Assignee: Husqvarna AB, Huskvarna, Sweden

[21] Appl. No.: 891,006

[22] Filed: Mar. 28, 1978

[30] Foreign Application Priority Data

Mar. 29, 1977 [SE] Sweden ..... 7703574

[51] Int. Cl.[2] ..... D05B 3/02

[52] U.S. Cl. ..... 112/158 E

[58] Field of Search ..... 112/158 E, 121.11, 121.12; 318/568

[56] References Cited

U.S. PATENT DOCUMENTS

| | | | |
|---|---|---|---|
| 3,450,076 | 6/1969 | Bender | 112/121.12 X |
| 3,765,349 | 10/1973 | Gerber | 112/121.12 X |
| 3,872,808 | 3/1975 | Wurst | 112/158 E |
| 4,092,938 | 6/1978 | Coughenour et al. | 112/158 E |
| 4,142,473 | 3/1979 | Itoh | 112/158 E |

*Primary Examiner*—Peter P. Nerbun

*Attorney, Agent, or Firm*—Holman & Stern

[57] ABSTRACT

Disclosed is an improvement in sewing machines wherein data circuits generate signals which are converted into movement of the stitch forming elements in predetermined patterns. In this improvement, computer algorithms are utilized to derive the signals which move the stitch forming elements. The parameters for these computer algorithms are stored in a number of blocks and in response to appropriate pattern select devices, the desired algorithm and desired parameters for the algorithm are selected which correspond to a desired stitch pattern.

5 Claims, 4 Drawing Figures

SEWING MACHINE WITH ELECTRONIC PATTERN DATA CIRCUITS

BACKGROUND OF THE INVENTION

The present invention relates to a sewing machine with electronic pattern data circuits for the generation of signals. These signals are then converted into movements of the stitch-forming elements of the machine, whereupon the machine then carries out a patterned set of stitches as a function of these signals.

As a part of the prior art in this field systems have been developed for the carrying out of patterned sets of stitches, which systems include electronic pattern elements for the generation of the said signals. A known example can be found in U.S. Pat. No. 3,752,098 wherein a machine is described comprising a movable fabric holder by means of which the fabric is displaced in patterned movements underneath the needle of the machine. The system in this method comprises a numerically controlled sewing machine in which a fabric and the up-and-down-moving needle are controlled in relation to one another as a function of a multiplicity of vector code words, each of which determines the direction and the length of each stitch and which together produce a contour according to which the stitches are formed. The system in question has the disadvantage, however, that the inertia in the mechanical control of the fabric to a large extent limits the choice of contours for the patterned sewing. The data storage in the system is comprised of tape which is programmed with the said vector code, but this form of storage is inferior to modern static stores. In this and in other respects the system can be considerably improved and developed. Such an improvement is represented by the present invention which is associated in particular with domestic sewing machines.

SUMMARY OF THE INVENTION

It is the object of the invention to provide a system of electronic pattern data circuits with storage cells, hereinafter called blocks, in which are stored data for the computation and production of control signals for the stitch-forming elements of the machine. The needle arm and presser foot mechanism as well as the shuttle and feeder of the sewing machine are assumed to be of conventional design. In each block, data for a number of stitches are stored in the form of an algorithm, that is to say, a number of output quantities for a data program which is carried out in a computer according to a schedule drawn up for each set of stitches or group of such sets. The stitches are then executed by the stitch-forming elements which are controlled by code converters causing controlled movements of the stitch-forming elements as a function of stitch code words produced in the computer. These stitch code words represent, in digitally coded form, x and y coordinates for each needle penetration of the fabric at the point of stitching and form together with the x/y coordinates for a preceding stitch a vector which is specific for the stitch which the machine performs at the moment. When the x/y coordinates for a preceding needle penetration are known, the stitch vectors or new coordinates for the needle penetration can be computed by means of an algorithm. The coordinates are thus produced during the course of the sewing itself and leave no remaining effect other than the set of stitches which the machine carries out.

In the following will be described a system of pattern data circuits for the production of stitch code words in a sewing machine for the stitching of a pattern when the output quantities are constituted by an algorithm according to the above. A system with the properties which have been described consists in accordance with the invention of electronic pattern data circuits wherein a computer unit carries out algorithms with the help of pulses from a stitch counter and parameters from a storage unit which parameters and/or types of algorithms are selected by means of settings on the pattern selecting elements on the machine.

BRIEF DESCRIPTION OF THE DRAWINGS

An embodiment of such a system is described with reference to the enclosed drawing wherein.

DETAILED DESCRIPTION OF A PREFERRED EMBODIMENT

Figure 1:
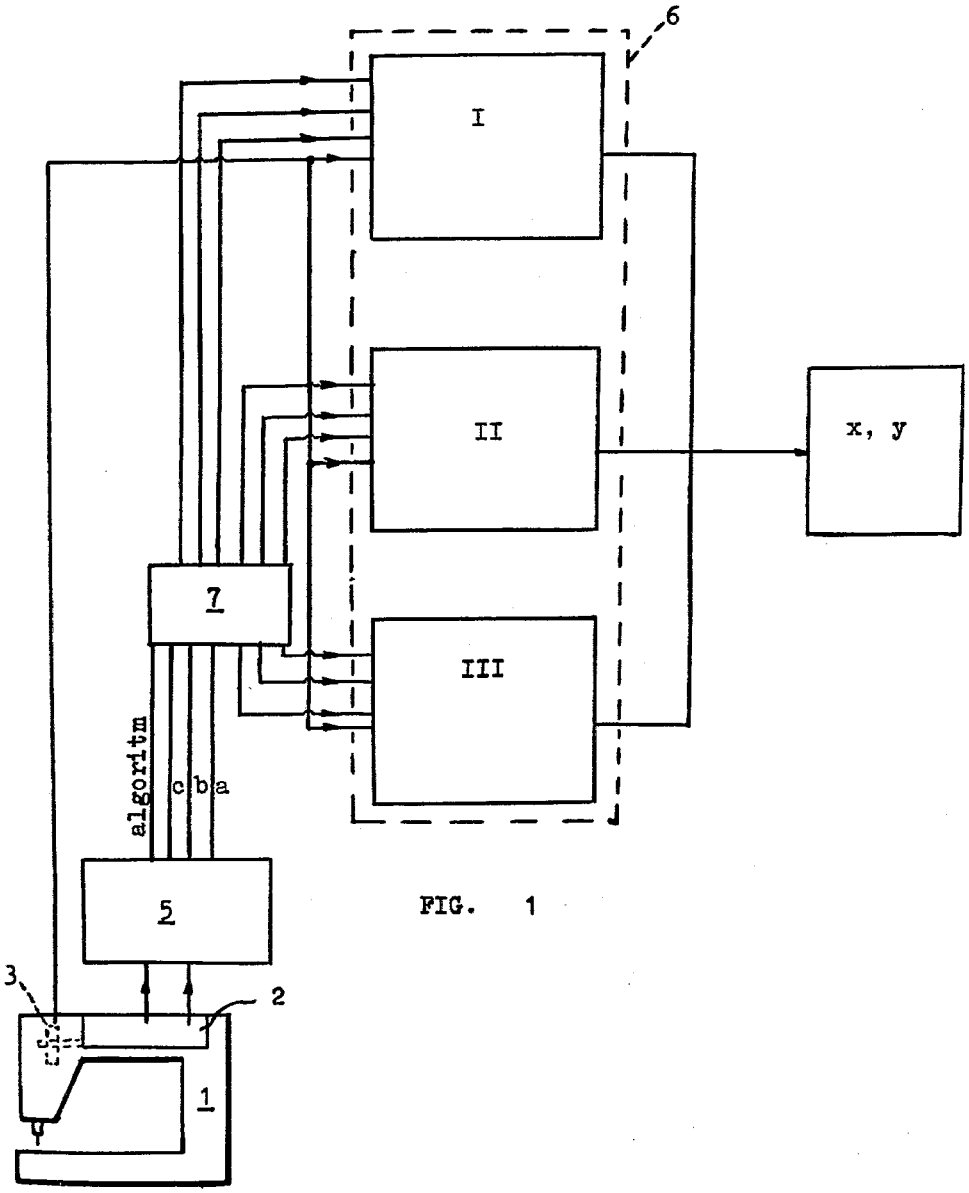
FIG. 1 is a block diagram of the units included in the system in connection with a sewing machine.

The general structure of the system is shown in FIG. 1 which includes a simplified picture of a sewing machine 1, on the front of which is fitted a pattern selecting device 2. On the axis of the upper arm of the machine is a level indicator 3 which by means of electric pulses indicates the angular position of the axis during each turn of the machine. Also connected is a stitch counter 4 (FIG. 3) which in a digitally coded manner maintains control of the number of the stitches carried out after the start of a special set of stitches or part thereof. By means of the pattern selecting device, instructions are transferred to the parameter storage 5 and further information regarding the special type of algorithm, selected is provided, which information is in the form of guiding pulses, for example, in digital code.

In FIG. 1 are shown three stitch variations contained in the computer unit 6, designated I, II and III. This division is intended to illustrate the function of the unit, and in an actual embodiment the variations would be in one unit. In each of the variants the x,y coordinates are calculated for the point of needle penetration and these coordinates are predetermined for each type of stitching pattern. In the embodiment shown three different sets of stitches are thus possible, but the number of variations is, of course, completely optional and a combination of several variations (algorithms) for the execution of the complicated sets of stitches is also possible. The parameter storage 5 transmits values of the parameters a,b,c . . . which are transferred to a distributor 7, to which are passed the "algorithm-type" signals to guide the "a,b, and c parameters" to any one of the variations I, II and III.

Figure 2:
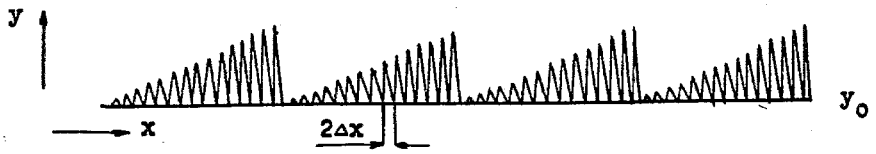
FIG. 2 is a plan view of a patterned set of stitches, a so-called triangular set of stitches.

In the following, an example of the computing process for a special stitch, a triangular set of stitches shown in FIG. 2, is discussed. The x and y coordinates in an imaginary coordinate system at the point of beginning is stitching shown by arrows, indicating that the x direction is the direction of feed and the y is direction the direction of deflection of the needle. The feed is maintained constant, that is to say $\Delta x =$ constant. After introduction of the parameter "stitch number" $= n$ it can be seen that the coordinate $x=n(\Delta x)$ is obtained. Moreover, a parameter k (the slope of the triangular stitch) is required to carry out the computation of the y coordinate which is composed of two expressions $y_{odd}=y_o$ and $y_{even}=k.\Delta x.n$, which applies to odd and even whole numbers respectively of n. When a triangle comprising N stitches has been completed, the stitch counter 4 is set to zero, that is to say, $n \rightarrow o$ and a new triangle is started. The quantities k, N, $\Delta x$ and $y_o$ are present as input in the parameter storage 5 and they are introduced as mentioned earlier into e.g. variation II of the computer unit. The transfer of the parameters may also be arranged by means of an external maneuvering element in the selection device 2, so that the parameters can be given optional values. This makes it possible to vary the triangular pattern, for example, short alternating with long or low alternating with high triangles.

Figure 3:
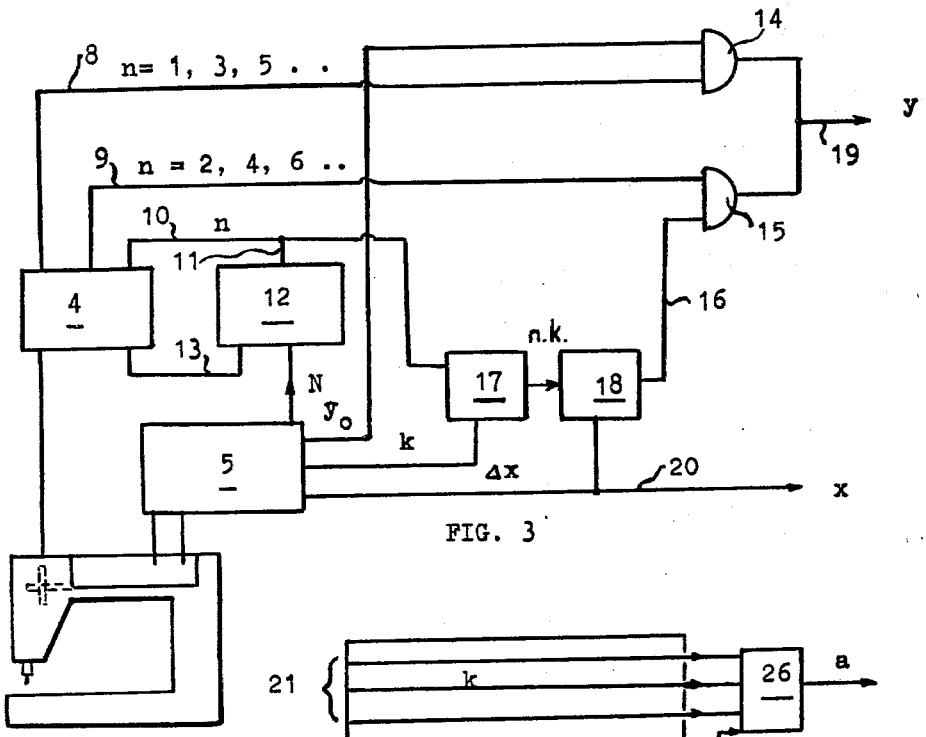
FIG. 3 is a schematic representation of the computer in the system.

The computation of the y-coordinate for each needle penetration is carried out in the variation II of the computer unit 6 which comprises the functions shown schematically in FIG. 3. From the stitch counter 4 issue signal transmission lines which may be referred to by numerals 8,9,10, where 8 refers to the transmission of a pulse when n is odd; 9 refers to the transmission of a pulse when n is even and 10 to the transmission of pulses representing the numbers n. From this line a branch 11 goes to a comparator 12 wherein the actual number n is compared with the parameter N and a signal is transmitted on a conductor 13 to the counter for resetting of the same when n=N. A group of AND gates 14 has one input connected to line 8 and the other to parameter $y_o$. When n is odd a signal is present on the line 8, and the gates transmit the code $y_o$ as obtained from the parameter storage. A second group of AND gates 15 has on its inputs, the line 9 and the lines 16 from a pair of multipliers 17,18 which produce the products n.k and $k.\Delta x.n$ respectively. When n is even a signal is present on the line 9, and the gates transmit the code $y=k(\Delta x.n)$. The two outgoing codes from the gates 14,15 are combined to the y coordinate for the needle penetration in the triangular pattern. The x coordinate for the feed vector, as mentioned previously, is $\Delta x$ and this parameter issues from the parameter storage 5. The coordinates x,y are transferred on outgoing lines 19,20 to the code converter (not shown).

Figure 4:
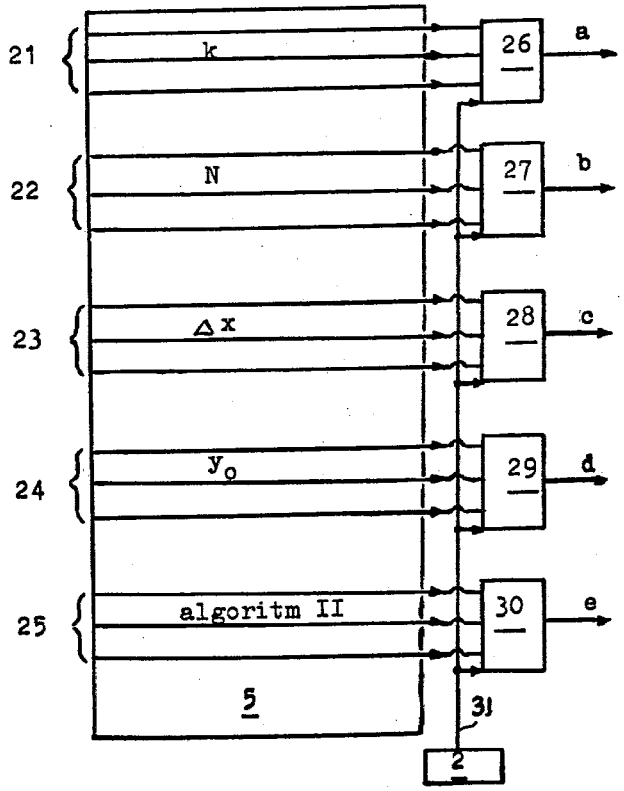
FIG. 4 is a schematic representation of a parameter storage in the system.

An example of an embodiment of the parameter storage 5 is represented schematically in FIG. 4. A static storage unit is divided into a number of partial stores 21–25 wherein the store cells contain coded values of the parameters and "algorithm" types. The codes are available at the outputs of the partial store which are combined in selector switches 26–30 for each partial store. On the instruction from the pattern selection device 2 a special code is selected via lines 31 on each selector switch and transmitted as parameter a,b,c, etc. to the computer unit. When the algorithm type for variation II is selected, the parameters a,b, c . . . represent the values of k,N, $\Delta x$ and $y_o$ in accordance with the example described.

What is claimed is:

1. In a sewing machine with electronic pattern data circuits for the generation of data signals, at least one motion converter means for producing, as a function of said signals, movements of the stitch forming elements of the machine, said movements generally comprising a sideways and vertically moving needle operating in conjunction with a fabric feeder and shuttle, an improvement wherein said data circuits comprise:

pattern select means for permitting a sewing machine operator to select a desired stitch pattern;

storage unit means for storing algorithm parameters and in response to said pattern select means, providing said parameters to an output;

stitch counter means for providing stitch count signals; and algorithm computer means, responsive to said output of said storage unit means and said pattern select means, for computing coordinates of a necessary point of needle penetration and providing signals to said motion converter means to orient said needle in accordance with the desired stitch in the pattern.

2. The improvement according to claim 1, wherein said algorithm computer means includes means responsive to said output of said stitch counter means for providing signals in accordance with a first algorithm for odd numbered stitches and for providing signals computed in accordance with a second algorithm for all even numbered stitches.

3. Improvement of claim 1 wherein said pattern select means includes means for successively selecting different algorithms for the execution of a desired pattern.

4. The improvement of claim 1 wherein said algorithm computer means includes means responsive to said stitch counter means for repeating a desired pattern after a predetermined number of stitches has been counted.

5. The improvements of claim 3 wherein said pattern select means includes means responsive to said stitch counter for changing the algorithm utilized in producing a stitch pattern after a predetermined number of stitches.

* * * * *